US005137544A

United States Patent [19]

Medellin

[11] Patent Number: 5,137,544

[45] Date of Patent: Aug. 11, 1992

[54] STRESS-FREE CHEMO-MECHANICAL POLISHING AGENT FOR II-VI COMPOUND SEMICONDUCTOR SINGLE CRYSTALS AND METHOD OF POLISHING

[75] Inventor: Daniel Medellin, Buena Park, Calif.

[73] Assignee: Rockwell International Corporation, Seal Beach, Calif.

[21] Appl. No.: 506,738

[22] Filed: Apr. 10, 1990

[51] Int. Cl.[5] ..... B24D 3/02

[52] U.S. Cl. ..... 51/308; 156/636; 156/645

[58] Field of Search ..... 51/283 R, 304, 308, 51/307, 309, 317; 156/636, 645

[56] References Cited

U.S. PATENT DOCUMENTS

| | | | |
|---|---|---|---|
| 3,775,201 | 11/1973 | Basi | 156/636 |
| 4,347,153 | 8/1982 | Hooper | 51/308 |
| 4,428,795 | 1/1984 | Kohl | 156/636 |
| 4,448,634 | 5/1984 | Lampert | 156/636 |
| 4,475,981 | 10/1984 | Rea | 156/645 |
| 4,645,561 | 2/1987 | Rea | 156/645 |
| 4,889,586 | 12/1989 | Noguchi | 156/636 |

*Primary Examiner*—James G. Smith

*Attorney, Agent, or Firm*—H. Fredrick Hamann; George A. Montanye; Wilfred G. Caldwell

[57] ABSTRACT

In the present invention Stress-Free Chemo-Mechanical Polishing Agent For II-VI Compound Semiconductor Single Crystals And Method Of Polishing, a II-VI compound semiconductor single crystal wafer is polished smooth to within 50 angstroms by using a mixture of water, colloidal silica and bleach including sodium hypochlorite applied under time and pressure control to achieve chemo-mechanical polishing. Many such compound crystals are not susceptible to polishing by prior art methods.

5 Claims, 3 Drawing Sheets

STRESS-FREE CHEMO-MECHANICAL POLISHING AGENT FOR II-VI COMPOUND SEMICONDUCTOR SINGLE CRYSTALS AND METHOD OF POLISHING

This invention was made with Government support under Contract No. F33615-87-C-5218 awarded by the Air Force. The Government has certain rights in this invention.

BACKGROUND OF THE INVENTION

1. Field of the Invention

This invention relates to polishing II-VI compound semiconductor single crystals to a mirror flat and stress-free condition.

2. Prior Art

For polishing thin films, it is conventional to use a bromine base solution as the polishing agent (e.g.) bromine methanol, bromine lactic acid or bromine ethylene glycol. However, bromine is very volatile and its fumes readily react with metals. It is really a pollutant which is hazardous to creatures. Another great disadvantage of bromine is the fact that control of the concentration of solution is not simple due to its volatility.

Control of smoothness in polishing single crystals is most critical, followed by control of flatness, and both depend upon being able to calculate the rate of material removal so overshoot is not encountered. The volatility of bromine renders this difficult if not impossible which is fatal when polishing thin films.

SUMMARY OF THE INVENTION

The substantially stress-free chemo-mechanical polishing agent for Group II-VI compound crystal semiconductors of the present invention comprises:

water (35–50)
colloidal silica (10–35)
bleach including approximately 5.25% sodium hypochlorite and inert materials (1–5).

This polishing agent is very stable, exhibits low volatility, is environmentally safe and polishes a wafer surface stress free to mirror flat.

The method of polishing the crystals uses the polishing agent to grind the semiconductor wafer while the time of exposing the wafer to the polishing agent and the pressure between the wafer and agent is controlled to obtain a wafer polished surface smoothness within fifty angstroms.

DETAILED DESCRIPTION OF A PREFERRED EMBODIMENT OF THE INVENTION

Figure 1:
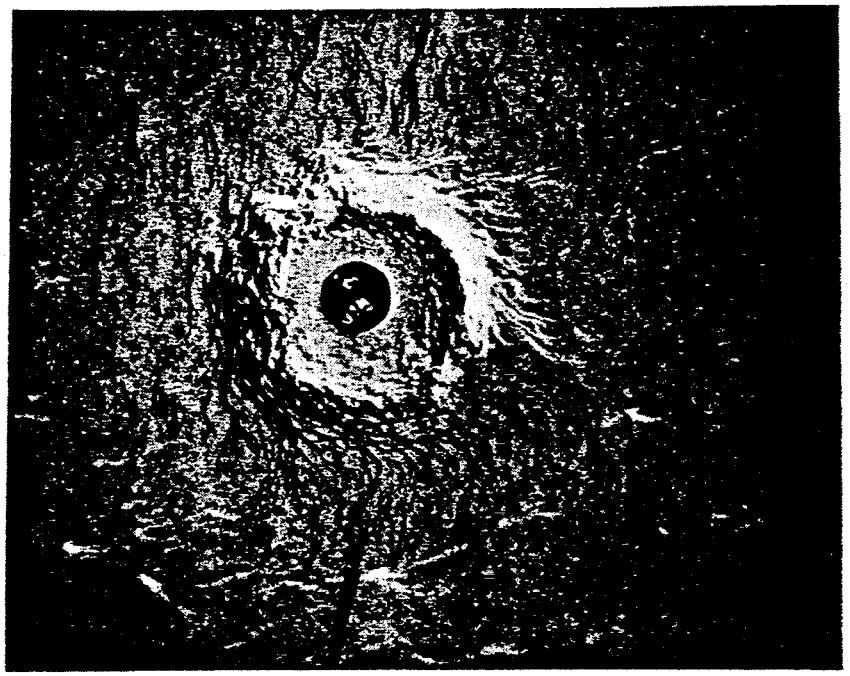
FIG. 1 is a photograph showing surface waviness of an as-grown wafer.
Figure 2:
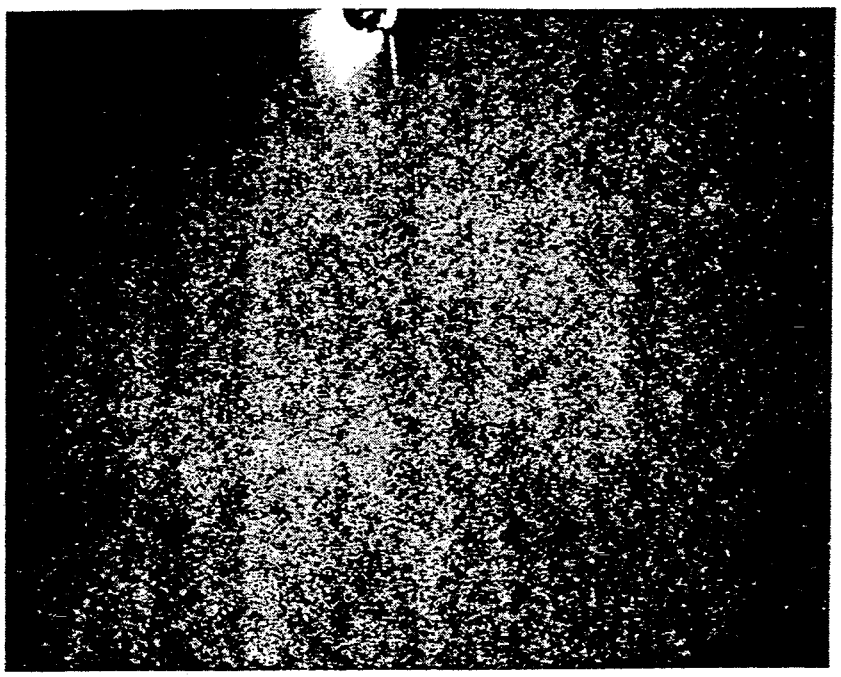
FIG. 2 shows the same wafer after chemo-mechanical polishing.

FIGS. 1 and 2 show respectively, surface waviness or lack of smoothness and the same surface after chemo-mechanical polishing in accordance with this invention.

The larger wavelets of FIG. 1 measure up to 2 microns and the wafer smoothness in FIG. 2 is less than 50 angstroms.

In the Group II-VI compound semiconductor crystals, it is desirable to polish many for vastly improved performance. Certainly, one of the most important is mercury cadmium telluride which is used for infrared detector arrays. Surface irregularities of the FIG. 1 type cause non-uniform resolution of the pattern in the photoresist lithography and even non-uniformity of the detector performance in the array. Without this invention, the process yield is unacceptably low in the II-VI compound infrared detector fabrication. Other useful compound semiconductor crystals from II-VI are cadmium telluride, cadmium sulfide, mercury telluride, zinc telluride and zinc sulfide.

Of these examples, it is sincerely believed that cadmium sulfide, mercury telluride, zinc telluride and zinc sulfide can only be polished using the subject polishing agent.

Figure 3:
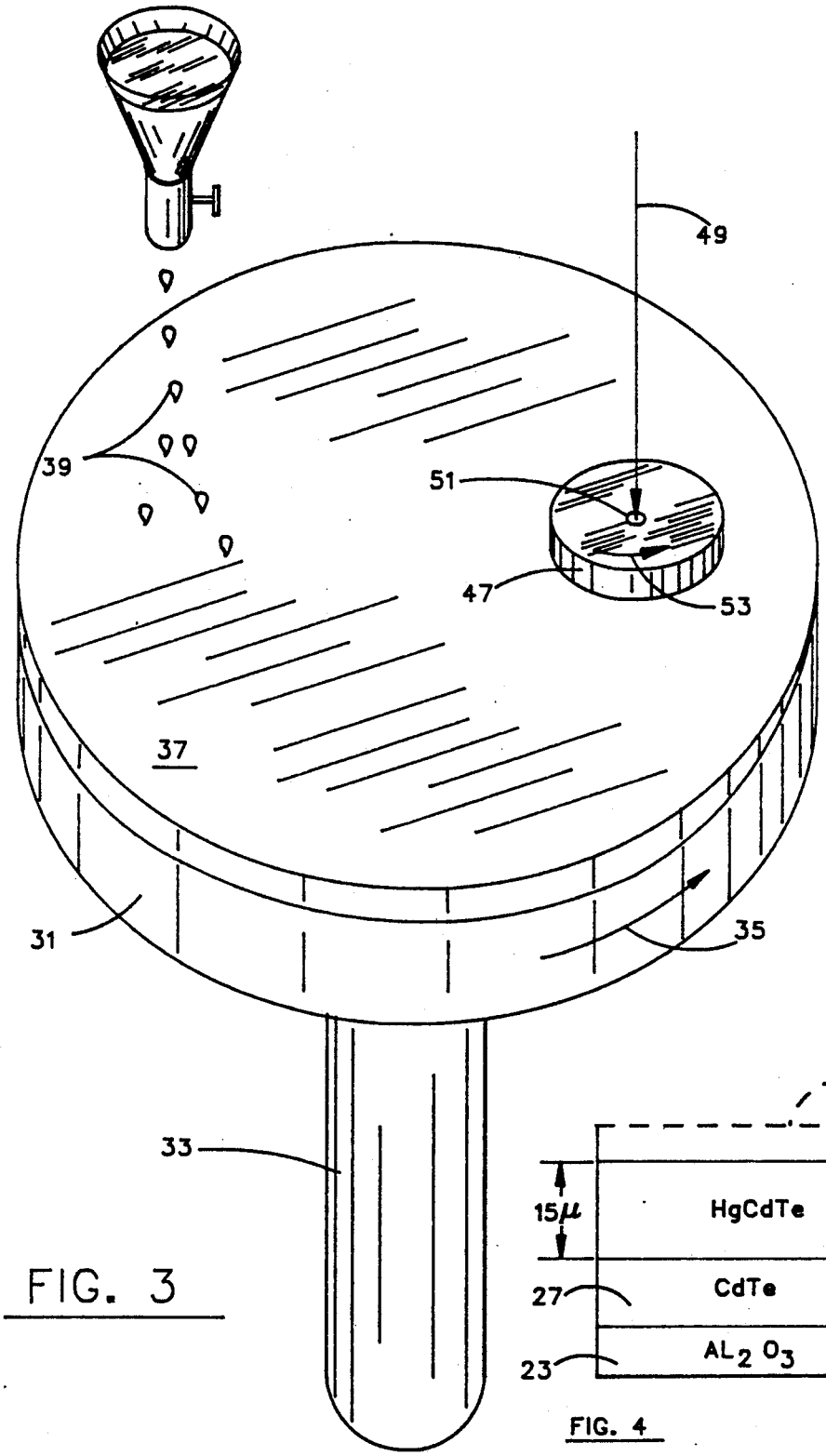
FIG. 3 is a schematic illustration in perspective showing the arrangement of parts to carry out the method of polishing in accordance with the present invention.
Figure 4:
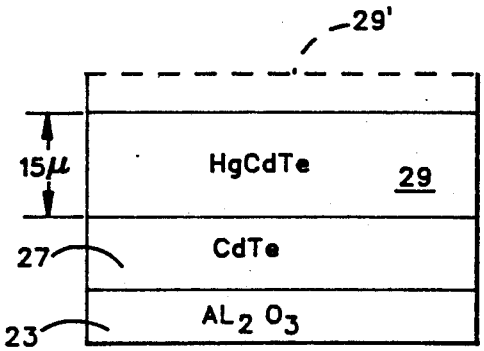
FIG. 4 shows a section through a sapphire wafer with a layer of cadmium telluride thereon grown by vapor phase epitaxial processing, and a mercury cadmium telluride layer on the cadmium telluride grown by liquid phase epitaxial processing.

In FIG. 4, a typical wafer structure suitable for use in the apparatus of FIG. 3 is shown with a sapphire wafer substrate 23, an intermediate cadmium telluride layer 27 and a mercury cadmium telluride single crystal 29 cut in substrate shape. The mercury cadmium telluride won't grow epitaxially on sapphire because of the large mismatching in the lattice constant between mercury cadmium telluride and sapphire so the intermediate cadmium telluride layer 27 is grown by vapor phase epitaxial processing and the mercury cadmium telluride is grown on the cadmium telluride by liquid phase epitaxial processing.

Also, in FIG. 4, an overgrowth 29′ of mercury cadmium telluride may occur to (e.g.) 19 or 20 microns for the target thickness, for example, 15 microns. The overgrowth 29′ may be removed by polishing, and may even provide an unexpected advantage because in polishing away the overgrowth 29′, better flatness may be achieved, depending upon how flat the wafer was to begin with and the yield may be greatly improved for flatness and smoothness.

By knowing the amount of overgrowth, calculations may be made as to the amount of time necessary to polish down to (e.g.) 15 microns.

A typical polishing removal rate may be 0.1 microns for 1 minute of polishing under a pressure of 100 to 120 grams/cm$^2$ of wafer area.

By way of example, one method of polishing is depicted in FIG. 3 wherein a turntable 31 is mounted on a pedestal 33 for rotation in the direction of arrow 35. The top of the turntable 31 is covered by a poromeric polyurethane pad 37 for receiving the polishing agent or slurry 39, dripped from a slurry holder 41 under control of the stopcock 43.

While not critical, the polishing agent is allowed to drip fast enough to maintain pad 37 saturated. Of course, excess slurry is drained into a sink or the like.

A wafer holder 47 has the wafer waxed to its lower side in contact with the pad 37 and polishing agent 39. The wafer and holder may be of any desirable size (e.g.) 3″ diameter.

A predetermined force is applied to the wafer holder along the axis or rod 49 by known weights or leverage to develop the (e.g.) 100 to 120 gram/cm$^2$ pressure on the wafer. Also, the axis rod 49 terminates in a central depression 51 in wafer holder 47 so that wafer holder 47 remains in the position shown but rotates in the direction of arrow 53 as the turntable 31 turns.

The preferred colloidal silica slurry is identified as NALCO® 2360 available from Nalco Chemical Company, 2901 Butterfield Road, Oak Brook, Ill. 60521. This slurry contains discrete spherical particles, wherein the particle size distribution, in combination with the large average particle size achieves excellent chemical-mechanical polishing. The average particle size is specified as 50–70 mμ.

The preferable mixture of the polishing agent contains sodium hypochlorite which is provided by commercially available products, for example, Purex® bleach which consists of 5.25% sodium hypochlorite and 94.75% inert ingredients. Purex Bleach-Distributed by the Dial Corporation, Phoenix, Ariz. 85077.

Following the polishing step, the wafer may be cleaned as follows:

1. Demount wafers from wafer holder.
2. Boil wafers in 1,1,1-trichloroethane, available from V. T. Baker TM Phillipsburg, N.J., to remove the wax.
3. Soak wafer in boiling acetone for 5 approximately minutes.
4. Soak wafer in boiling isopropyl alcohol for about 5 minutes.
5. Soak wafer for about 3 minutes in 1HF: 1 $H_2O$ solution.
6. Etch wafer in 0.100% bromine-methanol solution and quench in methanol.
7. Soak wafer in methanol for approximately 5 minutes.
8. Blow dry wafer with $N_2$ gas.

Figure 5:
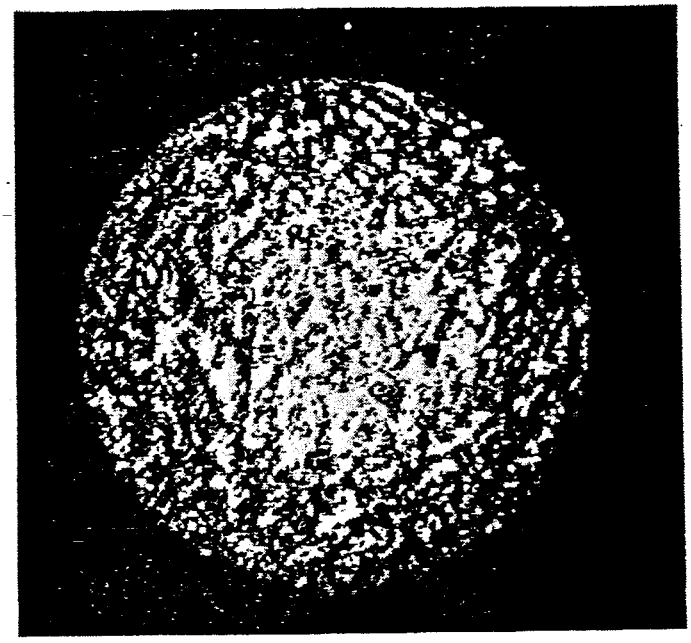
FIG. 5 is a photographic view of a wafer, through an interferometer, as-grown from mercury cadmium telluride; and, FIG. 6 shows the wafer after 100 minutes of polishing.
Figure 6:
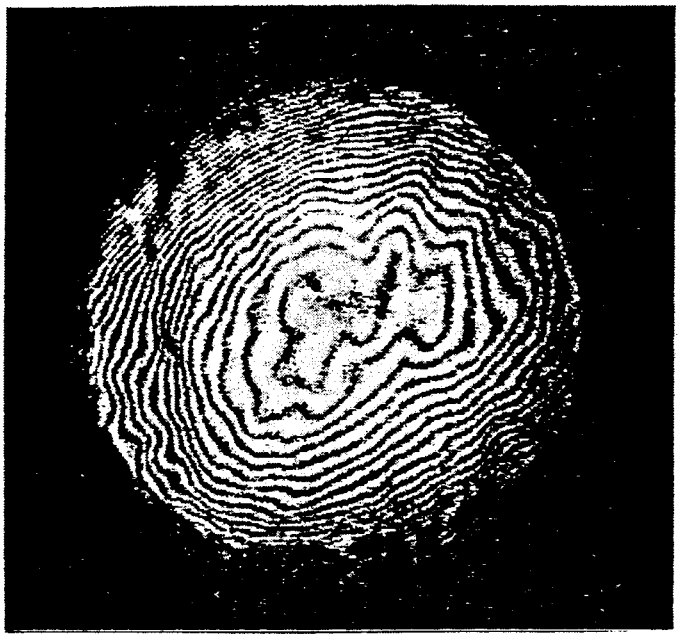

A relatively easy way to determine if the wafer is flat enough is to use an interferometer to look at the smoothness which is measured by light bands present on the surface. An irregular as-grown mercury cadmium telluride (FIG. 5) surface gives no visible pattern. After approximately 20 minutes of polishing, some fringe patterns are seen. After approximately 50 minutes of polishing, light bands are seen, and after about 100 minutes of polishing (FIG. 6), the entire wafer is all light bands.

The results of X-ray rocking curve measurements given in tables 1 and 2 show little change following the polishing procedure. This indicates that little or, no stress induced damage occurs from polishing.

TABLE 1: Rocking Curves of MCT (Mercury Cadmium Telluride) Layers Before Chemo-mechanical-Polish Four Mercury Cadmium Telluride wafers are measured using our usual method: CuKa 333 Mercury Cadmium Telluride reflection with 331 reflection from 111 Si first crystal. Beam size was approximately 1 mm wide by 2 mm high. Two measurements were made on each wafer: one near the center and one approximately one-half radius off center in the lower right quadrant (viewed with the primary flat at the top). The results are as follows:

| SAMPLE | FWHM (min) (ctr) | FWHM (min) (r/2) |
|---|---|---|
| IA-E-156 | 0.92 | 0.75 |
| IA-E-157 | 0.78 | 0.83 |
| IA-E-155 | 0.87 | 1.02 |
| UC-I-1 | 1.64 | 1.48 |

TABLE 2: Rocking Curves of Mercury Cadmium Telluride Layers After First Chemo-mechanical-Polish Mercury Cadmium Telluride wafers were measured after receiving a five minute chemo-mechanical-polish. The rocking curves were obtained using the same conditions as described in Table 1, which was prior to chemo-mechanical polishing. The results are as follows:

| SAMPLE | FWHM (min) (ctr) | FWHM (min) (r/2) |
|---|---|---|
| IA-E-156 | 0.91 | 0.81 |
| IA-E-157 | 0.83 | 0.73 |
| IA-E-155 | 0.72 | 0.87 |
| UC-I-1 | 1.70 | 1.26 |

In the present invention, the sodium hypochlorite oxidizes the crystal surface and the silica removes the oxide. The polishing is accomplished using the oxide polishing medium (this case silica).

For the II-VI compound semiconductor crystals, the present agent and process preferably removes between about 0.07 and 0.1 microns/min. as an average rate of removal.

What is claimed is:

1. A substantially stress-free chemo-mechanical polishing agent for Group II-VI compound crystal semiconductors, comprising in combination:

a mixture of water, colloidal silica and sodium hypochlorite wherein the volume of silica is many times the volume of sodium hypochlorite.

2. The agent of claim 1, wherein:

the volumetric ratio range for said mixture is as follows:

water 35–50 colloidal silica 10–35 bleach 1–5 including approximately 5.25% sodium hypochlorite.

3. The agent of claim 2, wherein:

the semiconductor comprises mercury cadmium telluride and the preferred ratio by volume of the agent components is:

water (35)

colloidal silica (35)

bleach 5 including approximately 5.25% sodium hypochlorite and the rest inert materials.

4. A substantially stress-free chemo-mechanical polishing agent for Group II-VI compound semiconductor single crystal thin films capable of achieving surface smoothness of the thin film to less than fifty angstroms, comprising in combination:

an aqueous solution of colloidal silica and sodium hypochlorite wherein the volume of silica is many times the volume of sodium hypochlorite.

5. The polishing agent of claim 4, wherein:

the volumetric ratio range for said solution is:

water 35–50 colloidal silica 10–35 bleach 1–5 including about 5.25% sodium hypochlorite.

* * * * *